US008931663B1

(12) United States Patent
Evans et al.

(10) Patent No.: US 8,931,663 B1
(45) Date of Patent: Jan. 13, 2015

(54) MOIST TOWELETTE TUB DISPENSER

(75) Inventors: Christopher T. Evans, Long Valley, NJ (US); Christopher Gieda, Long Valley, NJ (US)

(73) Assignee: Union Street Brand Packaging, LLC, Northborough, ME (US)

( * ) Notice: Subject to any disclaimer, the term of this patent is extended or adjusted under 35 U.S.C. 154(b) by 1705 days.

(21) Appl. No.: 10/918,459

(22) Filed: Aug. 16, 2004

Related U.S. Application Data

(60) Provisional application No. 60/494,794, filed on Aug. 14, 2003.

(51) Int. Cl.
*B65H 1/00* (2006.01)
*A47K 10/24* (2006.01)

(52) U.S. Cl.
USPC ..... 221/63; 221/48; 221/47; 221/46; 221/61; 221/44; 206/410; 206/440; 206/494; 222/254.5

(58) Field of Classification Search
USPC ..... 221/63, 48, 47, 46, 61, 44; 206/410, 206/440, 494; 220/254.5
See application file for complete search history.

(56) References Cited

U.S. PATENT DOCUMENTS 2,640,587 A * 6/1953 Smith ..... 206/37
2,826,230 A * 3/1958 Conell ..... 206/494
3,223,281 A * 12/1965 Larkin
3,982,659 A * 9/1976 Ross ..... 221/63
4,535,912 A * 8/1985 Bonk
4,735,317 A * 4/1988 Sussman et al. ..... 206/449
4,848,575 A * 7/1989 Nakamura et al. ..... 206/449
5,516,001 A * 5/1996 Muckenfuhs et al.
5,622,281 A * 4/1997 Annand
5,720,617 A * 2/1998 Var
5,729,955 A * 3/1998 Yamada
6,392,200 B1 * 5/2002 Nakamura et al. ..... 219/386
6,419,497 B1 * 7/2002 Carlson
6,499,626 B1 * 12/2002 Julius
6,554,156 B1 * 4/2003 Chong
2002/0056719 A1 * 5/2002 Morin et al.
2002/0190074 A1 * 12/2002 Morin et al. ..... 221/63
2003/0015543 A1 * 1/2003 Turbett et al.
2003/0155263 A1 * 8/2003 Morin ..... 206/494
2003/0155264 A1 * 8/2003 Morin ..... 206/494
2003/0221986 A1 12/2003 Reinke et al.

* cited by examiner

*Primary Examiner* — Rakesh Kumar
(74) *Attorney, Agent, or Firm* — James Creighton Wray

(57) ABSTRACT

The present invention is a system for dispensing horizontally stacked moist towelettes. One embodiment involves turning a tub upside down and providing a side door for accessing the stacked towels. Another embodiment involves orienting a tub in an upright position and providing a means for users to easily access the contents. Moist towelettes are dispensed one at a time, from beginning to end. Once one towelette is removed, the next is in position for removal. Any towelette that falls back into the tub can be easily retrieved through the opening without having to open the entire package.

50 Claims, 7 Drawing Sheets

MOIST TOWELETTE TUB DISPENSER

This application claims the benefit of U.S. Provisional Application No. 60/494,794, filed Aug. 14, 2003.

BACKGROUND OF THE INVENTION

Moist towelettes are commonly sold and used in consumer product markets. Many methods exist for packaging moist towelettes. However, there are no packages that have adequate dispensing mechanisms. Wipes and moist towelettes are generally packaged as center dispensing rolls in cylindrical containers or as stacks of individual horizontal towelettes.

Many existing packaging systems for moist towelettes either have no dispensing mechanism, or if there is a dispensing mechanism, it has many limitations that inhibit functionality and ease of use.

Current packages attempt to let customers remove one towelette at a time. Normally, the subsequent wipe in a package hangs out from the package for easy grasping. However, if a subsequent wipe falls back through the orifice in the cap and into the canister, current technology requires the user to remove the cap. This is often very difficult to do. The consumer must then re-thread the wipe through the cap orifice, and then reattach the cap to the canister for further single towelette dispensing. This is the same activity that a consumer must go through for first dispense of the package also.

Needs exist for improved methods for dispensing and storing moist towelettes that allow for easy dispensing.

SUMMARY OF THE INVENTION

The present invention is a system for dispensing horizontally stacked moist towelettes. One embodiment involves loading a stack of interleaved towels in an tub upside down, turning the tub right-side-up, and dispensing the towels by laterally accessing the top of the stack through a side door. Another embodiment involves orienting a tub in an upright position and providing a fixed means for users to easily access the contents. Moist towelettes are interleaved and are dispensed one at a time, from beginning to end. Once one towelette is removed, the next towelette is raised and positioned for removal. Any towelette that falls back into the tub is easily retrieved through an opening without having to open the entire package.

A first embodiment of the horizontal wipe dispenser of the present invention uniquely provides a side opening and draws top towelettes laterally from the top of a stack of towelettes. The dispenser container is generally square or rectangular, but can be shaped to accommodate various designs. A stack of horizontal wipes is stored in the center of the container. The lid that traditionally is on the top of a container is located on the bottom. This bottom lid opens to allow loading and refilling of the horizontal wipes. The bottom lid has a locking mechanism to prevent the dispenser from unintentional opening. Inverting the tub keeps the towelettes moist.

An opening is made on one of the sidewalls of the horizontal wipe enclosure. This opening is the dispensing location for the horizontally stacked wipes. A door covers the opening and is connected to the dispenser container by a living hinge. A detent or extension molded into the container engages a complementary detent or hook on the end of the door. The detents secure the door closed and preserve moisture when the container is not in use. The door can be of different sizes and configurations. In one embodiment, the door is wider towards the bottom lid and narrower towards the top of the container. The door is large enough for a user to reach in and grasp a horizontally stacked towelette from the top of the stack.

The dispenser is sized and shaped depending on the size and quantity of the wipes to be stored. The dimensions of each side are constructed accordingly.

The horizontal wipes are removed one at a time, or can be removed in larger numbers depending on the needs of the user. To operate the horizontal wipe dispenser, the user opens the door by pulling the end opposite the hinge away from the container. The user then reaches into the container and grasps the top horizontal wipe. The user pulls the top horizontal wipe out of the container and pushes the end of the door opposite the hinge towards the container to close the dispenser.

A further embodiment of the invention involves orienting a tub in an upright position and providing an upper door and a fixed inner access plate with openings for users to easily access the contents. The dispenser for horizontal wipes is generally square or rectangular but can have various configurations. Interleaved horizontally stacked and folded wipes are provided in the center of the enclosure. The top of the container is covered with a surface made of flexible material. Wipes pass through an opening in the surface.

The opening is divided into two or more sections by lobes. The lobes can have various configurations. Two lobes may divide the opening into a larger and smaller section or into two equal sized sections. Four lobes may divide the opening into three openings of equal or differing sizes. The opening sections can be two larger sections with one smaller section in the middle. A leading part of the top horizontal wipe is held by the lobes to provide easy removal of the next wipe.

A top lid is provided over the surface and opening. The lid is connected to one sidewall of the container through a living hinge. The end of the lid has a detent, hook or other device that connects to a complementary detent or extension on the corresponding side of the container.

The dispenser container allows a user to dispense one horizontal wipe at a time and prevents an end of a subsequent wipe from falling back into the container. To use the dispenser, a user unlocks the lid by rocking the end opposite the hinge away from engagement with the container and rotates the top upward. The user then grasps the exposed end of the top horizontal wipe and removes the wipe from the container. This brings the subsequent wipe through the opening in the surface. The user then closes the lid by pushing the end of the lid opposite the hinge towards the container. The lid then snaps and locks into place and prevents unintentional displacement when not in use.

The opening is large enough to allow a user to reach into the container and retrieve the first wipe or any fallen wipe. The first wipe or a fallen wipe can be accessed through a large section of the opening and then can be pulled upward through the opening and laterally into a smaller opening section. The lobes will prevent the next horizontal wipe from falling back into the container. There is no need for the user to open the entire container. The snapping shut of the lid conserves moisture in the towelettes and the inner surface and openings encourage one-by-one withdrawal of the towelettes.

These and further and other objects and features of the invention are apparent in the disclosure, which includes the above and ongoing written specification, with the claims and the drawings.

DETAILED DESCRIPTION OF THE PREFERRED EMBODIMENTS

The present invention is a system for dispensing horizontally stacked moist towelettes. One embodiment involves turning a tub upside down and providing a bottom door for loading stacked towelettes and a side door for accessing the stacked towels. Another embodiment involves orienting a tub in an upright position and providing a hinged top door and an inner lobed surface with a means for users to easily access the contents. Moist towelettes are dispensed one at a time, from beginning to end of a stack. When one towelette is removed, the next is in position for removal. Any towelette that falls back into the tub can be easily retrieved through the dispensing opening without having to open the entire package.

Figure 1:
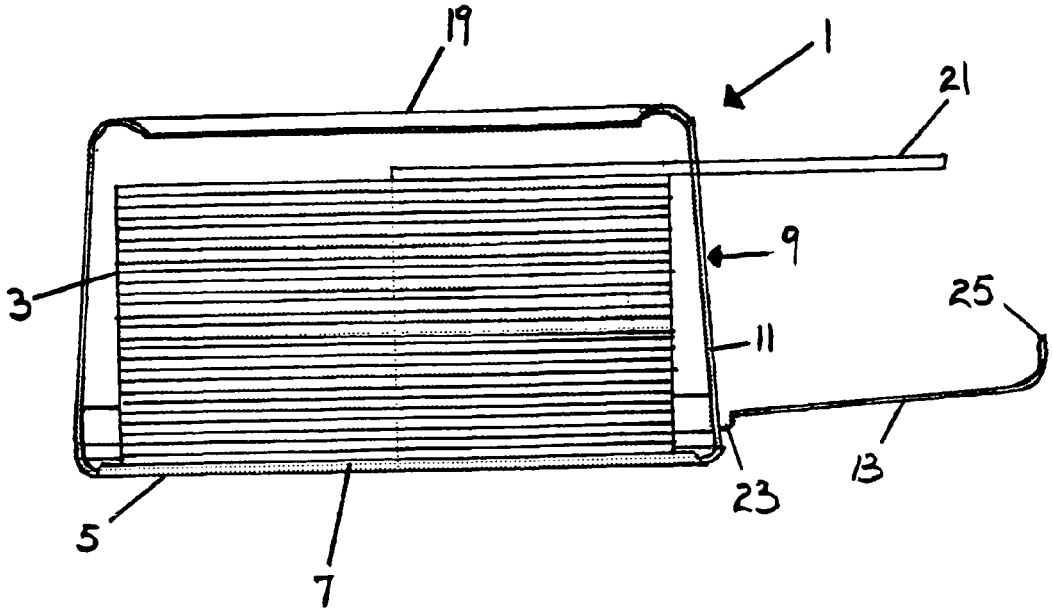
FIG. 1 is a side view cross-section of a dispenser with a side door partially opened and a moist towelette being removed laterally from a top of a stack.
Figure 2:
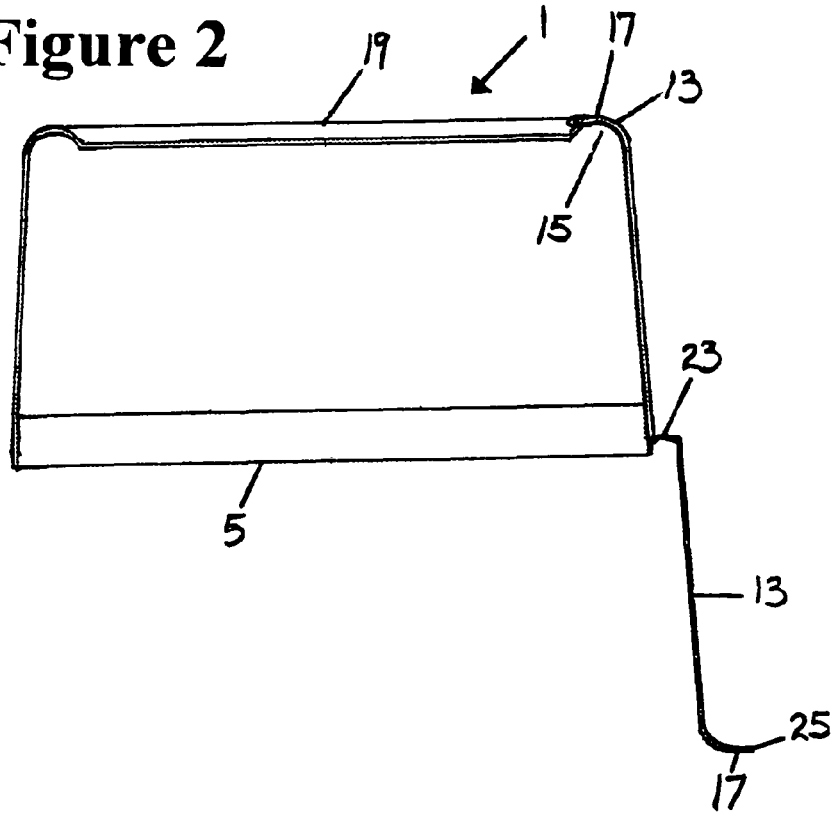
FIG. 2 is a side view cross-section of the dispenser showing the side door in fully opened and fully closed positions.
Figure 3:
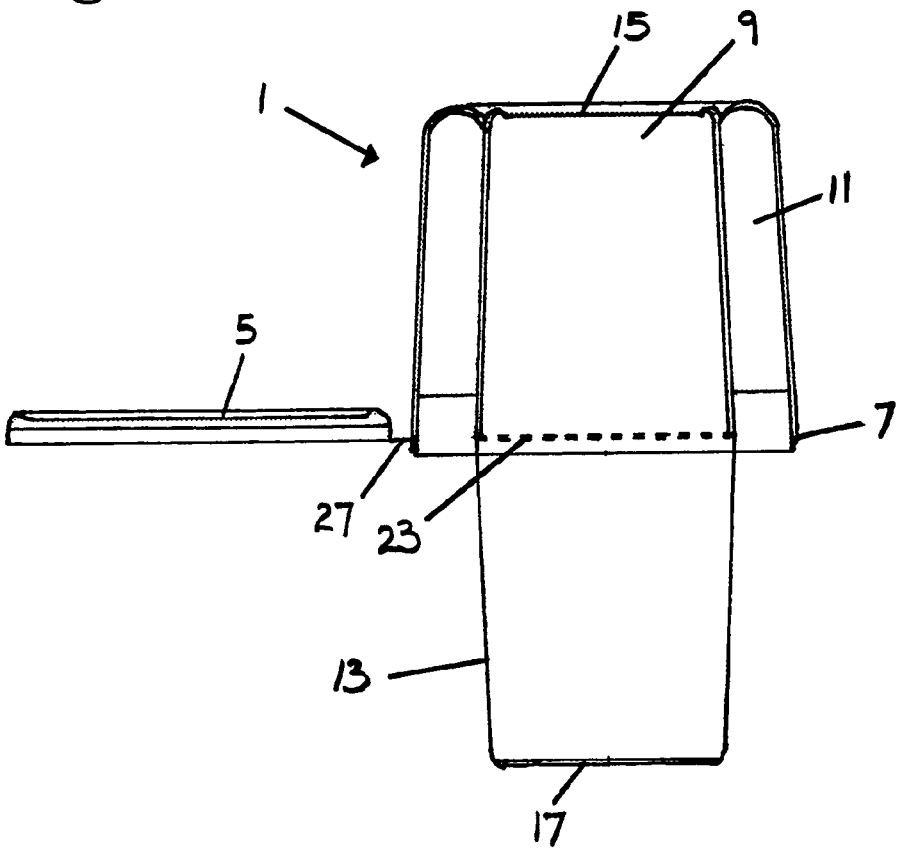
FIG. 3 is an end view of the dispenser with the side door opened and a bottom lid opened.

FIG. 1 shows an embodiment of the horizontal wipe dispenser 1 of the present invention that uses a tub turned upside down. FIG. 2 is a side view diagram of a dispenser 1 with a side door 13 shown in fully opened and fully closed positions. FIG. 3 is a front view diagram of a dispenser 1 with a side door 13 opened and a bottom lid 5 opened.

The dispenser container 1 is generally square or rectangular, but can be shaped to accommodate various designs. A stack of horizontal wipes 3 is stored in the center of the container 1. A lid 5 that might be expected on the top of the container is located on the bottom. This bottom lid 5 opens around a living hinge 23 to allow for loading and refilling of the horizontal wipes 3. The bottom lid 5 has a locking mechanism 7 with complementary snaps formed in the free end of the lid and in a corresponding part of the container to prevent the dispenser 1 from opening unintentionally.

An opening 9 is formed in one of the sidewalls 11 of the horizontal wipe enclosure. This opening 9 is where the horizontal wipes 3 are dispensed. A door 13 covers the opening and is connected to the dispenser container by a living hinge 23. An extension 15 is molded in a top edge 19 of the container 1 for engaging a hook 17 on the free end 25 of the door 13. Snapping the hook on the extension secures the door 13 closed when not in use. The door 13 is opened by lifting or pushing outward on the free end 25. The door 13 can be of different sizes and configurations. The door 13 can be wider towards the bottom lid 5 and narrower towards the top 19. The door 13 and opening 9 are large enough to allow a user to reach in, and laterally grasp and withdraw the top horizontal wipe 21.

The dispenser 1 is differently sized and shaped depending on the size and quantity of the wipes 3 to be stored. The dimensions of each side are constructed accordingly.

The horizontal wipes 3 are removed one at a time, or can be removed in larger numbers depending on the needs of the user. To operate the horizontal wipe dispenser 1, the user opens the door 13 by pulling the end 25 of the hook 17 opposite a hinge 23 away from the container 1. The user then reaches into the opening 9 in the container 1 and grasps the top horizontal wipe 21. The user pulls the top horizontal wipe 21 out of the container 1 and pushes the end 25 of the door 13 opposite the hinge 23 towards the container 1 to close the dispenser 1.

Figure 4:
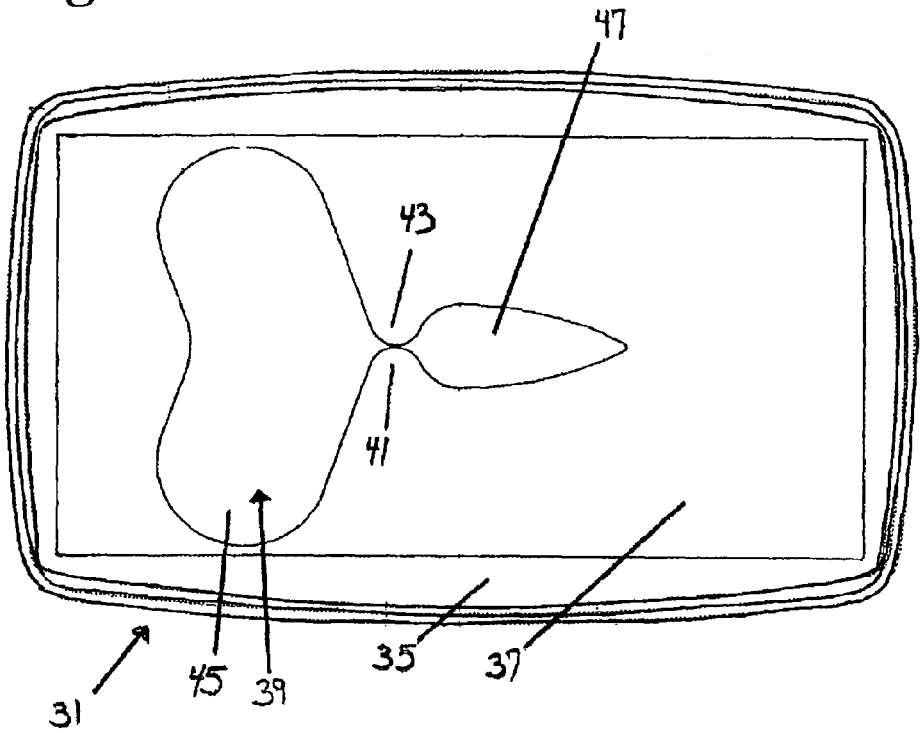
FIG. 4 is a top view of another embodiment of the dispenser showing inner surface large and small openings and lobes separating the openings.
Figure 5:
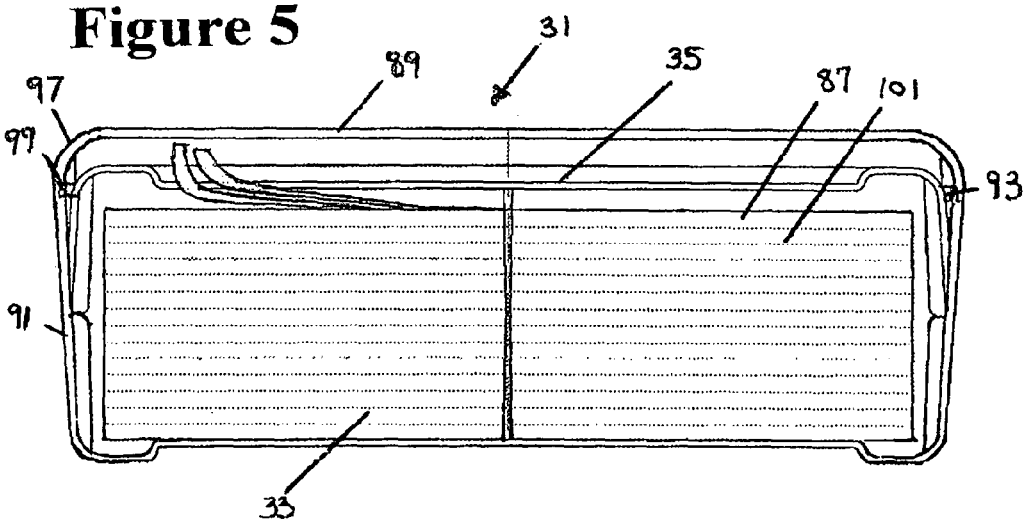
FIG. 5 is a side view cross-section of the dispenser with a top closed.
Figure 6:
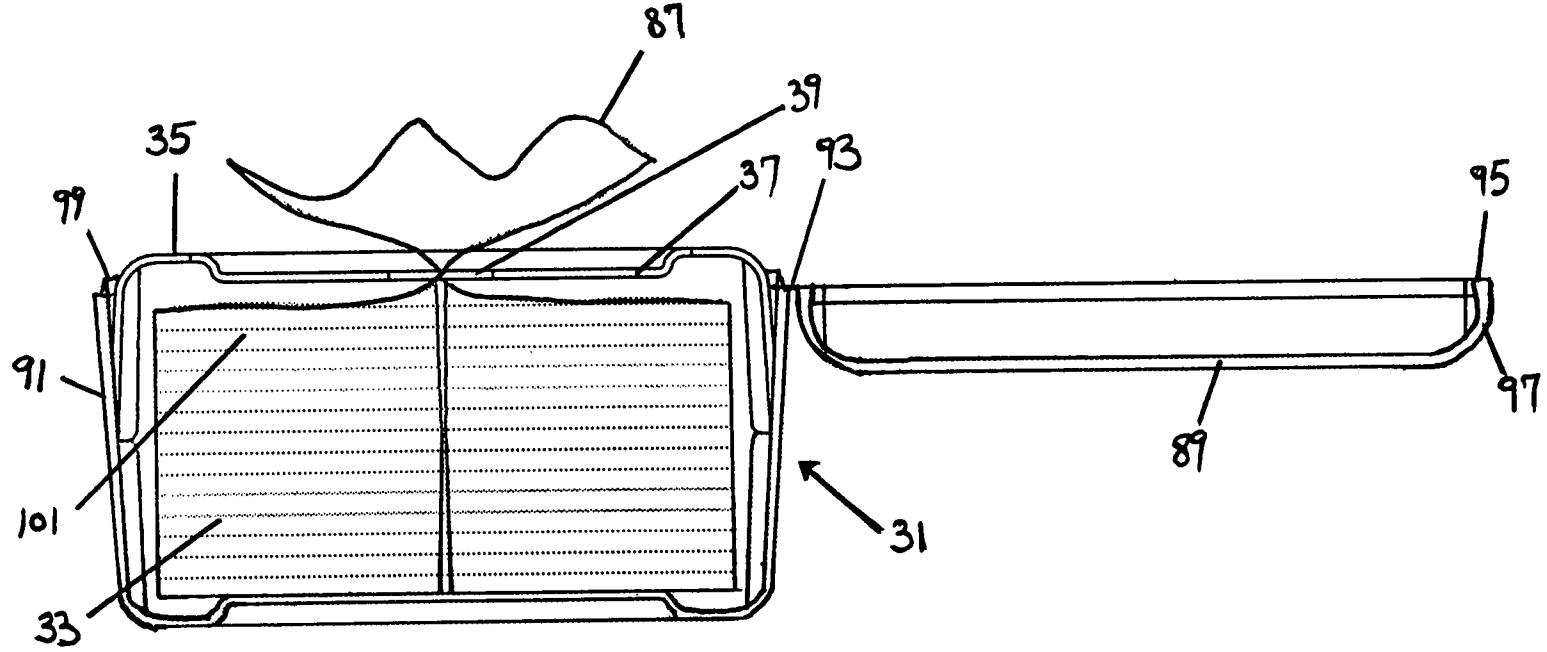
FIG. 6 is a cross-sectional end view of the dispenser with the top opened about a living hinge.

FIG. 4 shows an embodiment where a tub 31 is oriented in an upright position and with a means for users to easily access the contents. FIG. 5 is a side view diagram of a dispenser with a top closed and also shows multiple wipes 33 being removed at one time. FIG. 6 is a side view diagram of a dispenser with a top open. The dispenser 31 for horizontal wipes 33 is generally square or rectangular but can have various configurations. The center of the enclosure 31 contains a stack of horizontal wipes 33. The top 35 of the container 31 is covered with a surface 37 made of flexible material. The wipes 33 pass through an opening 39 of the surface 37.

Figure 7:
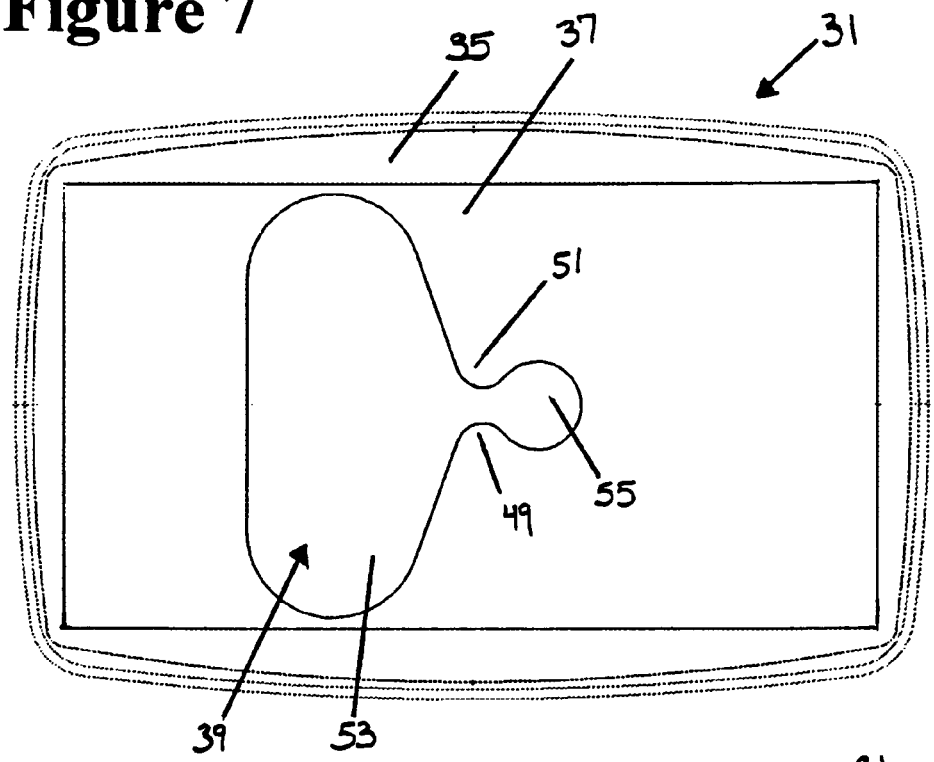
FIG. 7 is a top view of the dispenser with an alternate opening and lobe configuration in the inner surface.
Figure 8:
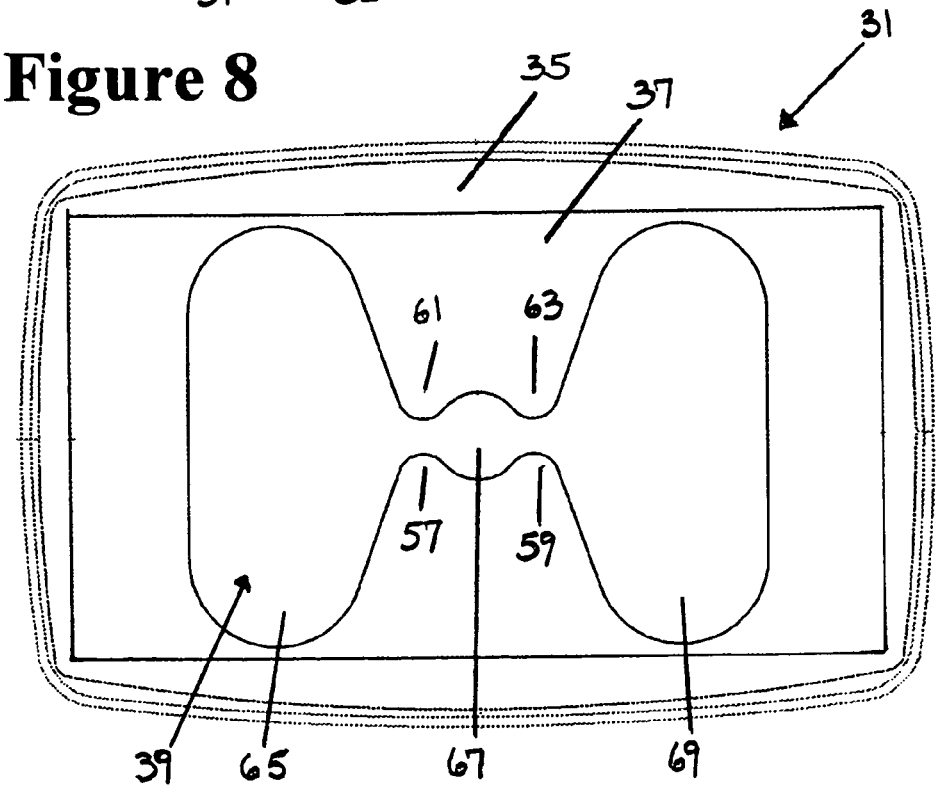
FIG. 8 is a top view of the dispenser with an alternate opening and lobe configuration in the inner surface.
Figure 9:
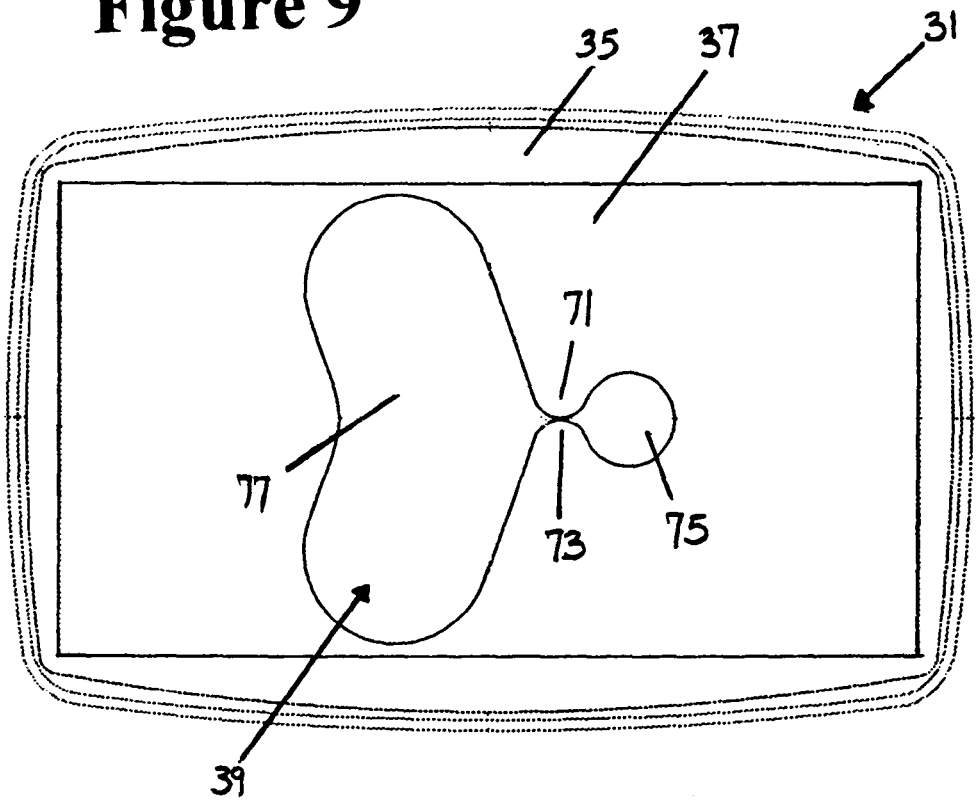
FIG. 9 is a top view of the dispenser with an alternate opening and lobe configuration in the inner surface.
Figure 10:
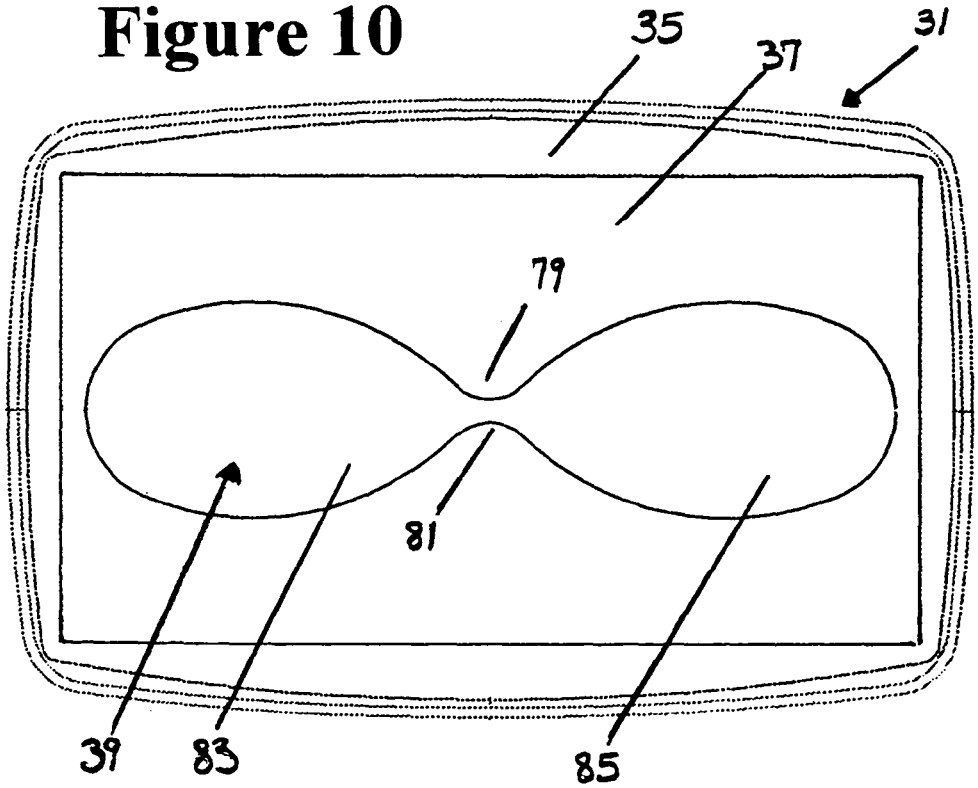
FIG. 10 is a top view of the dispenser with an alternate opening and lobe configuration in the inner surface.

The opening 39 is divided into two or more sections 45, 47 by lobes 41, 43. The lobes 41, 43 can have various configurations. Two lobes 49, 51 may divide the opening 39 into larger 53 and smaller 55 sections, as shown in FIG. 7. Four lobes 57, 59, 61, 63 may divide the opening 39 into three openings 65, 67, 69 of various sizes, as shown in FIG. 8. The sections may be two larger sections with one smaller section in the middle or three equal sections. FIG. 9 is a diagram of a double lobe 71, 73 configuration forming a small round section 75 and a larger kidney shaped section 77. FIG. 10 is a diagram of a double lobe 79, 81 configuration with two equivalent elliptical sections 83, 85. The top horizontal wipe 87 is kept out of the enclosure by the lobes.

A top lid 89 covers the surface 37 and opening 39. The lid 89 is connected to one sidewall 91 of the container 31 through a living hinge 93. The end of the lid 95 has a hook 97 or other device that connects to an extension 99 on the corresponding side of the container 31.

The dispenser 81 container allows a user to dispense one horizontal wipe 87 at a time and prevents subsequent wipes 33 from falling back into the container 31. To use the dispenser 31, a user unlocks the lid 89 by pulling the end 95 opposite the hinge 93 away from the container 31. The user then reaches through a larger opening and grasps the exposed top horizontal wipe 87, partially lifts the wipe through the large opening and then moves it past the lobes to the smaller opening, and removes the wipe 87 from the container 31. This brings the subsequent wipe 101 through the smaller portion 47 of the opening 39 in the surface 37. The user then closes the lid 89 by pushing the end 95 of the lid opposite the hinge 93 towards the container 31. The lid 89 then snaps and locks into place and prevents unintentional opening when not in use.

The larger portion of the opening 39 is large enough to allow a user to reach into the container 31 and retrieve any fallen wipes 33. The fallen wipe 33 can then be pulled upwardly through the larger portion 45 and laterally into the smaller portion 47 of the opening 39 and the lobes will prevent the horizontal wipe 33 from falling back into the container 31. There is no need for the user to open the entire container 31.

FIGS. 4 and 7-10 differ in the shapes of the larger access portions 45, 53, 65, 69, 77 and smaller restraining and holding portions 47, 55, 67, 75 of the openings 39 and in the shapes of the opposing lobes 41, 43, 49, 51, 61, 63, 57, 59, 71, 73, 79, 81. FIG. 10 has equal openings 83, 85, and the space between the lobes 79, 81 restrains and holds the end of the next towelette.

Figure 11:
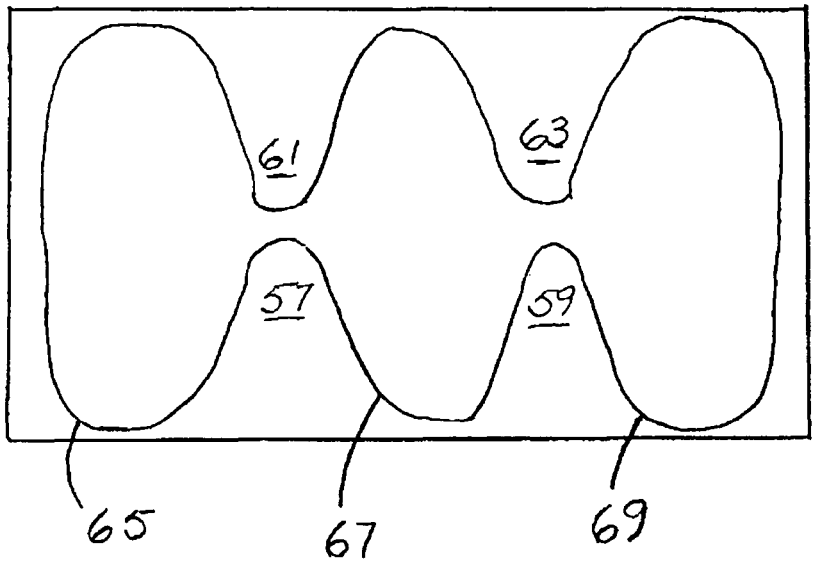
FIG. 11 is a top view of the dispenser wherein four lobes divide the opening in the flexible covering into three equal regions.

FIG. 11 is a top view of the dispenser wherein four lobes 57, 59, 61, 63 divide the opening in the flexible covering into three equal regions 65, 67, 69.

While the invention has been described with reference to specific embodiments, modifications and variations of the invention may be constructed without departing from the scope of the invention, which is defined in the following claims.

The invention claimed is:

1. A horizontal wipe dispenser comprising:
an enclosure with a top wall and a bottom wall,
one or more side walls between the top wall and the bottom wall,
an opening on at least one side wall,
a door covering the entire opening on the at least one side wall,
a hinge connecting an end of the door to the at least one side wall,
a detent or hook on an end of the door opposite the hinge,
a complementary detent or extension on the top wall or the bottom wall or the at least one side wall of the enclosure for engaging the detent or hook on the end of the door opposite the hinge and for securing the door in a closed position,
wherein the bottom wall is a bottom lid for loading and refilling the dispenser, and
a stack of horizontal wipes in the enclosure removable through the opening on the at least one side wall.

2. The dispenser of claim 1, wherein the dimensions of the stack of horizontal wipes determine the dimensions of the enclosure.

3. The dispenser of claim 1, wherein the hinge is a living hinge.

4. The dispenser of claim 1, wherein the hinge connects the door to the bottom wall.

5. The dispenser of claim 1, further comprising a locking mechanism on the bottom lid for preventing unintentional opening.

6. The dispenser of claim 1, wherein the bottom lid is connected to one of the side walls by a hinge.

7. The dispenser of claim 6, further comprising a detent or hook on an end of the bottom lid opposite the hinge.

8. The dispenser of claim 7, further comprising a complementary detent or extension on a side wall opposite the hinge for receiving the detent or hook on the bottom lid and securing the lid in a closed position.

9. The dispenser of claim 8, wherein the detent or hook on the bottom lid is snapped into the complementary detent or extension on the side wall for closing the dispenser.

10. The dispenser of claim 8, wherein the detent or hook on the bottom lid is unsnapped from the complementary detent or extension on the side wall for opening the dispenser.

11. The dispenser of claim 8, wherein the detent or hook on the door is snapped into the complementary detent or extension on the top wall for closing the dispenser.

12. The dispenser of claim 8, wherein the detent or hook on the door is unsnapped from the complementary detent or extension on the top wall for opening the dispenser.

13. The dispenser of claim 1, wherein more than one wipe can be removed at one time.

14. The dispenser of claim 1, wherein the opening is large enough for a user to reach into the enclosure and grasp one or more horizontal wipes.

15. The dispenser of claim 1, wherein the door decreases in width from the hinge end to the hook end.

16. The dispenser of claim 1, wherein horizontal wipes are removed one at a time.

17. The dispenser of claim 1, wherein the stack of horizontal wipes are interleaved.

18. A horizontal wipe dispenser comprising:
an enclosure with one or more side walls, a top wall and a bottom wall,
an opening in the top wall of the enclosure,
a lid for covering the opening,
a hinge connecting the lid to an end of one side wall,
a detent or hook on the end of the lid opposite the hinge end,
a complementary detent or extension for engaging the hook on one side wall opposite the hinge side wall,
a stack of horizontal wipes in the enclosure vertically removable from the enclosure,
a flexible covering across the opening and above the stack of horizontal wipes,
an opening in the flexible covering, and
one or more lobes of the flexible covering protruding into the opening in the flexible covering.

19. The dispenser of claim 18, wherein the one or more lobes contact each other at their tips across the opening in the flexible covering.

20. The dispenser of claim 18, wherein the one or more lobes do not contact each other across the opening in the flexible covering leaving a gap.

21. The dispenser of claim 18, wherein the one or more lobes divide the opening in the flexible covering into regions.

22. The dispenser of claim 21, wherein four lobes divide the opening in the flexible covering into two larger regions and one smaller central region.

23. The dispenser of claim 21, wherein four lobes divide the opening in the flexible covering into three equal regions.

24. The dispenser of claim 21, wherein two lobes divide the opening in the flexible covering into two equal regions and the opening is symmetrical about at least two axes.

25. The dispenser of claim 21, wherein two lobes divide the opening in the flexible covering into two unequal regions.

26. The dispenser of claim 21, wherein the at least one region in the flexible covering is large enough for reaching in and retrieving fallen wipes.

27. The dispenser of claim 26, wherein a fallen horizontal wipe is pulled vertically through a larger region and then laterally past the one or more lobes into a smaller region for preventing the subsequent horizontal wipe from falling back into the enclosure.

28. The dispenser of claim 22, wherein the opening is symmetrical about at least two axes.

29. The dispenser of claim 22, wherein the four lobes comprise two sets of two oppositely disposed lobes and the regions are formed to the sides of the sets of lobes.

30. The dispenser of claim 18, wherein the horizontal wipes are dispensed one at a time.

31. The dispenser of claim 18, wherein the dimensions of the stack of horizontal wipes determine the dimensions of the enclosure.

32. The dispenser of claim 18, wherein the hinge is a living hinge.

33. The dispenser of claim 18, wherein the detent or hook on the lid is snapped into the complementary detent or extension on the side wall for closing the dispenser.

34. The dispenser of claim 18, wherein the detent or hook on the lid is unsnapped from the complementary detent or extension on the side wall for opening the dispenser.

35. The dispenser of claim 18, wherein a subsequent horizontal wipe is secured between the one or more lobes between uses of the dispenser for preventing the subsequent horizontal wipe from falling back into the enclosure.

36. The dispenser of claim 18, wherein the horizontal wipes are pulled through the opening in the flexible covering for dispensing.

37. The dispenser of claim 18, wherein the flexible covering is a flexible membrane.

38. A method of dispensing horizontal wipes comprising:

providing an enclosure with one or more side walls and a top wall, providing an opening in one of the side walls of the enclosure completely covered by a door hinged to the wall of the enclosure on one end and removably connected to the top wall by a detent or hook on the end of the door opposite the hinge and a complementary detent or extension on an opposite wall, providing a stack of horizontal wipes in the enclosure, opening the door by pulling the detent or hook on the end of the door opposite the hinge away from the complementary detent or extension on the top wall of the enclosure, reaching into the enclosure through the opening in the one of the side walls and grasping one or more horizontal wipes, removing the one or more horizontal wipes, and closing the door by pushing the detent or hook on the end of the door opposite the hinge towards the complementary detent or extension on the opposite wall of the enclosure wherein the bottom wall is a bottom lid for loading and refilling the dispenser.

39. The method of claim 38, further comprising a locking mechanism on the bottom lid for preventing unintentional opening.

40. The method of claim 38, further comprising providing a locking mechanism on the end of the door opposite the hinge for securing the door closed.

41. The method of claim 38, further comprising snapping the detent or hook on the bottom lid into the complementary detent or extension on the wall for closing the dispenser.

42. The method of claim 38, further comprising unsnapping the detent or hook on the bottom lid from the complementary detent or extension on the opposite the hinge wall for opening the dispenser.

43. The method of claim 38, wherein the hinge is a living hinge.

44. A method of dispensing horizontal wipes comprising:

providing an enclosure with one or more side walls, a top wall and a bottom wall, providing a stack of horizontal wipes in the enclosure, providing an opening in the top wall of the enclosure covered by a flexible covering with an opening in the flexible covering and at least one lobe protruding into the opening in the flexible covering and separating the opening in the flexible covering into sections, providing a lid connected to one of the side walls by a hinge and removably connected to an opposite side wall by a detent or hook on an end of the lid opposite the hinge and a complementary detent or extension on the opposite side wall for receiving the detent or hook on the lid and securing the lid in a closed position, opening the lid by pulling the detent or hook on the end of the lid opposite the hinge away from the complementary detent or extension on the opposite side wall of the enclosure, grasping part of a top horizontal wipe that extends above the flexible covering, pulling the horizontal wipe vertically out of the enclosure, securing part of the subsequent horizontal wipe between the one or more lobes, and closing the lid by pushing the detent or hook on the end of the lid opposite the hinge towards the complementary detent or extension on the opposite side wall of the enclosure.

45. The method of claim 44, wherein the one or more lobes divide the opening in the flexible covering into multiple regions.

46. The method of claim 45, wherein the at least one region is large enough for reaching in and retrieving fallen wipes.

47. The method of claim 44, wherein the horizontal wipes are dispensed one at a time.

48. The method of claim 44, wherein the dimensions of the stack of horizontal wipes determine the dimensions of the enclosure.

49. The method of claim 44, wherein the hinge is a living hinge.

50. The method of claim 44, further comprising reaching through the opening for retrieving a horizontal wipe within the enclosure and securing the horizontal wipe between the one or more lobes.

* * * * *